United States Patent [19]

Heed

[11] Patent Number: 4,741,690

[45] Date of Patent: May 3, 1988

[54] PROCESS FOR COMBUSTION OR DECOMPOSITION OF POLLUTANTS AND EQUIPMENT THEREFOR

[76] Inventor: Björn Heed, Utlandagatan 19, S-412 61 Göteborg, Sweden

[21] Appl. No.: 848,397

[22] PCT Filed: Jun. 19, 1985

[86] PCT No.: PCT/SE85/00257

§ 371 Date: Feb. 18, 1986

§ 102(e) Date: Feb. 18, 1986

[87] PCT Pub. No.: WO86/00389

PCT Pub. Date: Jan. 16, 1986

[30] Foreign Application Priority Data

Jun. 21, 1984 [SE] Sweden ..... 8403330

[51] Int. Cl.[4] ..... F23D 3/40

[52] U.S. Cl. ..... 431/7; 431/170; 122/4 D; 110/245; 110/345

[58] Field of Search ..... 431/5, 7, 170, 329, 431/328, 326; 34/191, 219, 35, 86, 76, 77; 110/245, 345; 122/4 D

[56] References Cited

U.S. PATENT DOCUMENTS

| | | | |
|---|---|---|---|
| 2,795,054 | 6/1957 | Bowen | 34/35 |
| 3,769.922 | 11/1973 | Furlong et al. | 110/245 |
| 3,888,193 | 6/1975 | Kishigami et al. | 110/245 |
| 3,942,264 | 3/1976 | Zenker | 34/35 |
| 4,310,020 | 1/1982 | Jespersen | 34/191 |
| 4,475,884 | 10/1984 | Shang et al. | 431/7 |

*Primary Examiner*—James C. Yeung

*Attorney, Agent, or Firm*—Balogh, Osann, Kramer, Dvorak, Genova & Traub

[57] ABSTRACT

Process to ascertain combustion and/or decomposition of gaseous and/or by air or other gas carried particulate pollutants. The invention makes possible an effective and safe combustion and/or decomposition of pollutants not desired to escape into the environment. The pollutants are fed into a combustor (1) in which the pollutants are self combusted and/or are made to self decompose, whereby in the combustor outgoing gas is made to heat ingoing gas and/or by air or other gas carried particulate pollutants through counter current regenerative heat exchange. The invention also refers to an equipment for accomplishment of the process.

13 Claims, 1 Drawing Sheet

PROCESS FOR COMBUSTION OR DECOMPOSITION OF POLLUTANTS AND EQUIPMENT THEREFOR

Figure 1:
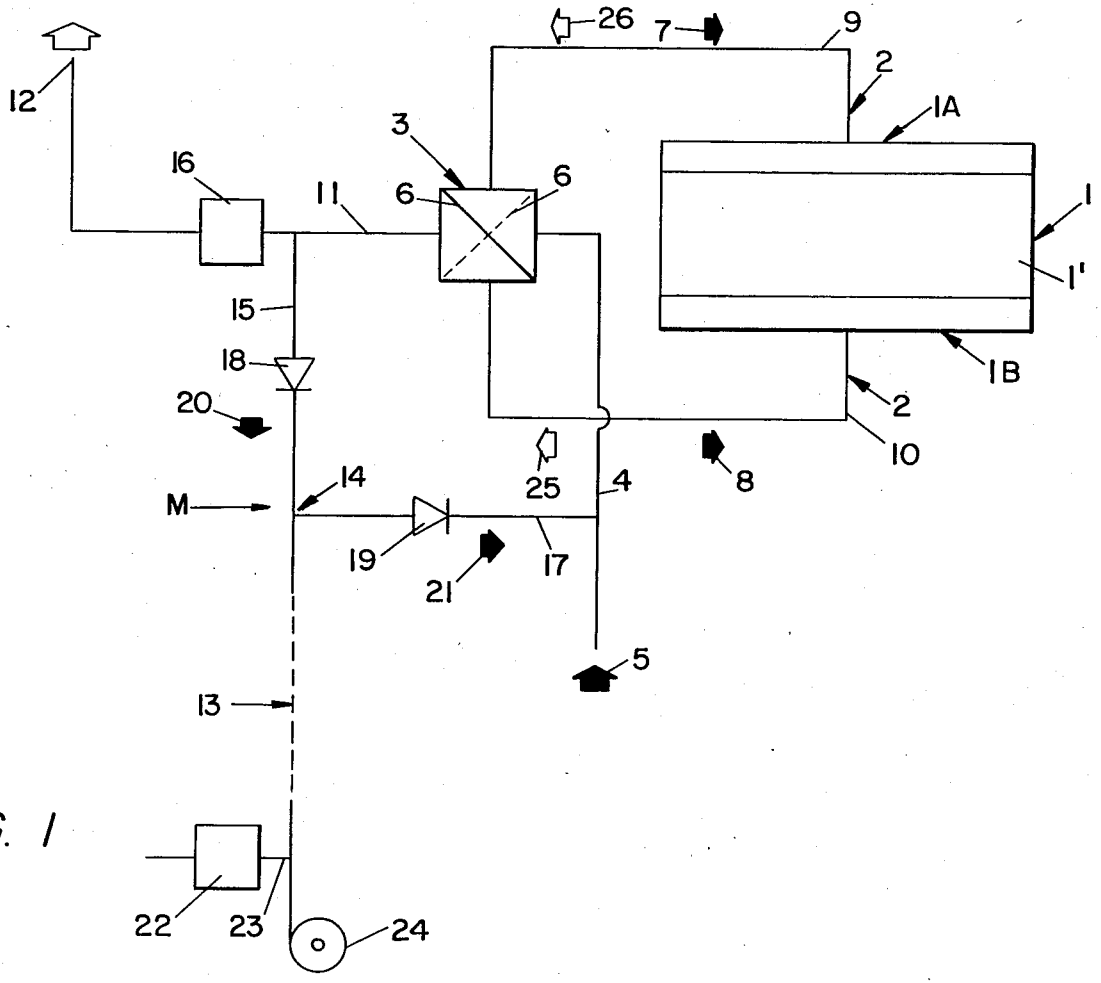

The rate of a combustion reaction is very sensitive to temperature and the rate increases strongly with increasing temperature. In a combustion process it is necessary that the temperature of the flame or combustion zone is high enough to make the reaction proceed with reasonable speed.

In an ordinary flame this is accomplished by the fact that heat from reacted gas heats not yet reacted gas. For a flame to survive it is then necessary that the heat generated in a gas volume during the reaction is enough both to cover losses to the environment and to heat adjacent not yet reacted gas to a temperature sufficiently high to make the combustion process proceed there.

Even for good fuels like hydrogen and hydrocarbons the case may be that generated heat is not sufficient. The flame then dies. This is the case when the concentration of burnables in an air mixture is too low (or so high that the oxygen concentration is too low). When judging the danger for a possible explosion a common concept is lower (or upper) explosion limit.

In many cases there are emissions of inherently energy rich and easily combusted substances where, however, their concentrations are so low that they cannot support an ordinary combustion. This is the case for instance with evacuated air from many paint and printing shops.

To purify such air by combustion of the solvents there are two conventional ways:

1. The administration of heat to the air for instance by means of support flames so that the whole gas mixture is heated to a temperature high enough. This method is simple and usually works well, but when the original concentration is low it demands much energy for the heating, which makes this method expensive.

2. The use of catalysts. By using catalysts it is possible to make a combustion process proceed at a comparatively low temperature. This is done by making the gas pass over the catalyst which has the capability to make a combustion process proceed although both temperature and concentrations of burnables are low. Hereby much energy is saved compared to method 1 above. However, the method has some drawbacks, for instance:

(a) Catalysts are expensive.

(b) Catalysts are easily destroyed by certain impurities in the gas even if their concentration is low (catalyst poisons).

(c) Catalysts usually are sensitive to temperature and destroyed at too high temperatures. Consequently, gas mixtures with too high concentrations of burnables cannot be treated and the whole process is sensitive to variations of concentration of burnables.

The present invention relates to a process for the establishment of combustion and/or decomposition of pollutants in the form of gas or particles carried by air or other gas.

The main object of this invention is to bring about a process of the above mentioned kind which makes possible an effective and reliable combustion and/or decomposition of pollutants for instance obtained in industry such as air evacuated from paint spraying booths or nitrogen oxides and thereby prevent harmful gases and particles from entering the environment.

This object is attained by a process according to the present invention of which the main characteristics are that the pollutants are fed into an apparatus in which the pollutants are heated to self combustion and/or decomposition temperature while warmer treated gas flowing through the bed in direction towards the exhaust part of the combustion device is allowed to heat inflowing gas and/or by air or other gas carried particles by means of regenerative countercurrent heat exchange.

A second object of the invention is to present an apparatus by means of which the above mentioned process can be practised.

Said second object is accomplished by an apparatus according to the present invention characterized by said apparatus incorporating a bed filled with sand, stone or the like having the ability to store heat and exchange heat and having means for heating of the inner portion of said bed to self decomposition temperature and/or self combustion temperature for instance by means of an electric heater in the bed or by means of gaseous fuel.

The invention is described below as a preferred arrangement whereby reference is made to the enclosed drawing which schematically shows an apparatus capable of performing the process according to the invention.

A "combustor" 1 which preferably is suited to be used effectively according to the invention comprises a bed of sand, stone or other material which has the ability to store and exchange heat and to combust and/or decompose gaseous or particulate pollutants carried by air or other gas in the bed. For instance air evacuated from pain spraying booths or other gases which contain burnable gases etc. and/or for instance nitrogen oxides or other gases possible to decompose can be combusted and/or decomposed in said bed 1. This is only due to the high temperature, i.e. without the bed participating in the reaction otherwise than as a means to establish the high temperature. For the purpose of accomplishing an effective self combustion and/or self decomposition of the pollutants in the bed 1 the latter is equipped with means of appropriate kind to heat it preferably in the middle portion of the bed to desired self decomposition and/or self combustion temperature, for instance by means of an electric heater or by means of oil or gaseous fuel. A conduit 2 communicating with the two ends 1A and 1B respectively of the combustor 1 also communicates with a device 3 for periodic changing of the direction of flow which can be manually and/or automatically operated. After start of the apparatus 1, i.e. heating the bed to the self combustion and/or self decomposition temperature of the medium intended to be treated, the intention is to preferably let the pollutants in question be fed into it by means of conduit 2 in order to drive the apparatus 1, but mainly to ascertain a complete combustion of said pollutants which may be harmful or odorous like paint gases.

The feeding of pollutants to the device 3 for changing of flow direction is done through a duct 4 from the inlet 5.

Changing of the direction of flow by means of the device 3 by for instance an incorporated valve 6 which can be switched between two alternative positions makes the feeding of pollutants coming via the inlet 5 to the combustor in one or the other of the two directions 7 or 8 by means of ducts 9 or 10. Said duct 2 also works as outlet for air and/or gas from the combustor 1 to an exhaust duct 11 which leads from the flow direction changer 3 to an exhaust 12.

The counter current regenerative heat exchange occurring in the bed makes it possible to use the heat contents of the treated gas which leaves through the bed 1' of the combustor 1 to heat the gas and/or air or of other gas carried particulate pollutants which are being fed inwards through said bed 1'. Preferably this is done so that maximum temperature and combustion and/or decomposition occurs in the central parts of the bed 1'. This is accomplished by changing of the direction of gas flow through the combustor 1 and its bed 1' at suitable time intervals by means of the gas flow direction changer 3. Hereby it is made possible to keep the maximum of the temperature profile in the central parts of the combustor bed where said combustion and/or decomposition is desired to take place.

After start of operation of the combustor at desired self combustion and/or self decomposition temperature by using the above mentioned heating means the combustion and/or decomposition of the pollutants can often proceed by influence from the heat of the bed 1' without having any extra energy supplied by the heating means. This is the case when heat produced by the reaction in the bed is enough to compensate for unavoidable heat losses from for instance incomplete heat exchange in the bed.

In cases when the pollutants are rich in energy, produced excess heat could be utilized by extraction at desired temperature level by means of cooling tubes installed at suitable positions in the bed.

A storing device M which makes possible a safe reception of pollutants which are fed from the inlet 5 to the changing device 3 during the time said changing device 3 is being switched over for the reversal of the flow direction in the conduit 2 to the combustor 1 is connected to the outlet duct 11 after the direction changer 3, as seen in the direction of the flow. This is done to prevent pollutants to escape in connection with the above described interchange of point of feed and point of outlet of gas/air. Preferably said storing device M comprises a comparatively long duct 13 which makes it possible to temporarily store air/gas of said kind. A circuit 14 which comprises an entrance duct 15 which is connected to the exhaust duct 11 before an incorporated valve 16 or the like and an outlet 17 which is connected to the inlet duct 4 is connected to said long duct 13 or the like in store M incorporated reception reservoir. One way valves 18 and 19 which make it possible to convey air and/or gas in the direction of the arrows 20 and 21 on the drawing to and from the store M, but are designed to automatically shut off flow in the opposite direction, are incorporated in the inlet and outlet ducts 15 and 17, respectively. A valve 22 is incorporated in a duct 23 leading for instance outside from the store M and a fan 24 or some other type of blowing machinery is connected to the store M. This fan can preferably be run continuously while the device is operating. Changing of flow is made possible according to the following: Positions of the valve 6 at the switching device 3 according to the continuous line in the drawing will convey the pollutants in the direction 7 in the conduit 2 into the combustor 1 and convey treated gas to the outlet 12 from the combustor 1 in the direction 25. Reversal of the valve 6 according to the dashed line on the drawing will convey the pollutants from the entrance 5 to the combustor 1 in the direction 8 and thus treated gas by means of the circuit 9 to the exhaust 12 in the direction 26. When opening valve 22 the one way valve 19 is automatically shut so that possible gas flowing towards exhaust 12 is instead conveyed into the store M when valve 16 has been shut off and the one way valve 18 opened. This is done when changing the direction of gas flow by means of the device 3 and the circuits are blown through for a certain time after the change of direction to make pollutants not desired to escape instead go into the store M. Thereafter the valve 16 is opened whereby one way valve 18 is automatically shut off and valve 22 is closed so that one way valve 19 automatically opens. Air/gas stored in M is then fed to the inlet duct 4 and to the combustor 1 in the above mentioned way by means of the fan 24 in the direction of arrow 21. The store M thus makes possible an effective storage of harmful air/gas which otherwise could have escaped during the changing of direction of flow.

The invention is not limited to the embodiment described above and shown on the drawing, but can be varied within the limits of the claims without differing from the scope of the invention.

I claim:

1. A process for treatment of gas, vapor, or air-borne particulant pollutants comprising the steps of:

feeding the pollutant gas into a chamber having a heated bed with heat-accumulating and heat-exchanging properties, to raise the termperature of the pollutant gas to cause combustion or decomposition thereof; and reversing the direction of gas flow in the chamber to cause treated pollutant gas to raise the termperature of the incoming untreated pollutant gas comprising the step of re-routing pollutant gas from the input of the heated chamber to a storage chamber at the time of the changing of direction of gas flow, and from which storage chamber, the pollutant gas is later routed back into the heated chamber.

2. A process as claimed in claim 1, comprising the step of heating the central portion of the heated bed to a gas decomposition or combustion temperature, at least during the starting point of the process, by means of a heater positioned within the heated bed, whereby pollutant gas heated by the central portion of the bed will heat the exit-adjacent-portion of the bed.

3. A process as claimed in claim 1, comprising the step of re-routing partially treated gas pollutant from exhaust discharge and into said storage chamber to avoid exhausting of untreated pollutant gas.

4. A process as claimed in claim 3, comprising the step of forcing untreated pollutant gas stored in said storage chamber back into the heated chamber for processing.

5. A process as claimed in claim 1, comprising the step of extracting by means of cooling tubes, the surplus heat generated in said heated chamber.

6. An apparatus for treatment of gas, vapor, or air-borne particulant pollutants comprising:

a heated chamber in the form of a bed of sand, stone, or other material having heat-accumulating and heat-exchanging properties.

means for heating through an external fuel source, a central portion of said bed to a temperature that will cause combustion or decomposition of the pollutant gas passing thereover; and means for alternating the direction of pollutant gas into the heated chamber for treatment to cause gas flow in opposite, alternate directions.

7. Apparatus as claimed in claim 6, comprising means for changing the direction of pollutant gas entry and exit from said heated chamber to cause a reverse in direction of gas flow over the heating means.

8. Apparatus as claimed in claim 6, comprising a storage means for temporarily storing gas during the change of direction procedure to avoid release from the system of uncompletely treated pollutant gas, and means for returning gas stored in the storage means back to the heated chamber for processing.

9. Apparatus as claimed in claim 6, comprising cooling tubes positioned within said heating bed to enable extraction of excess surplus heat from the system.

10. An apparatus for treatment of gas, vapor, or airborne particulant pollutants comprising:

a heated chamber in the form of a bed of sand, stone, or other material having heat-accumulating and heat-exchanging properties;

means for heating a central portion of said bed to a temperature that will cause combustion or decomposition of the pollutant gas passing thereover; and means for alternating the direction of pollutant gas into the heated chamber for treatment to cause gas flow in opposite, alternate directions.

11. Apparatus as claimed in claim 10, comprising means for changing the direction of pollutant gas entry and exit from said heated chamber to cause a reverse in direction of gas flow over the heating means.

12. Apparatus as claimed in claim 10, comprising a storage means for temporarily storing gas during the change of direction procedure to avoid release from the system of uncompletely treated pollutant gas, and means for returning gas stored in the storage means back to the heated chamber for processing.

13. Apparatus as claimed in claim 10, comprising cooling tubes positioned within said heating bed to enable extraction of excess surplus heat from the system.

* * * * *